US006705575B1

(12) United States Patent
Hoy

(10) Patent No.: US 6,705,575 B1
(45) Date of Patent: Mar. 16, 2004

(54) DISPOSABLE BAG WITH STAND

(76) Inventor: Marian A. Hoy, P.O. Box 158, Johnson City, TX (US) 78636

( * ) Notice: Subject to any disclaimer, the term of this patent is extended or adjusted under 35 U.S.C. 154(b) by 0 days.

(21) Appl. No.: 10/345,981

(22) Filed: Jan. 17, 2003

(51) Int. Cl.[7] ..... B65B 67/04
(52) U.S. Cl. ..... 248/99; 248/97; 383/33
(58) Field of Search ..... 248/95, 97, 99, 248/100, 101, 907; 383/33, 80, 96

(56) References Cited

U.S. PATENT DOCUMENTS

| | | | | | |
|---|---|---|---|---|---|
| 590,606 | A | | 9/1897 | Young | |
| 755,085 | A | | 3/1904 | Viano | |
| 960,451 | A | | 6/1910 | Vicary | |
| 2,528,332 | A | | 10/1950 | Berquist | |
| 3,614,041 | A | * | 10/1971 | Koger | 248/97 |
| 3,841,592 | A | * | 10/1974 | Witten | 248/101 |
| 3,870,261 | A | * | 3/1975 | McSwain | 248/101 |
| 3,893,649 | A | * | 7/1975 | Cornell et al. | 248/99 |
| 4,312,489 | A | | 1/1982 | Paetzold | |
| 4,328,904 | A | | 5/1982 | Iverson | |
| 4,378,924 | A | | 4/1983 | Christensen | |
| 4,667,911 | A | * | 5/1987 | Farris et al. | 248/97 |
| 4,765,579 | A | * | 8/1988 | Robbins et al. | 248/101 |
| 4,842,228 | A | * | 6/1989 | Kasper | 248/97 |
| 4,884,717 | A | | 12/1989 | Bussard et al. | |
| 4,899,967 | A | * | 2/1990 | Johnson | 248/97 |
| 4,919,546 | A | | 4/1990 | Imazeki et al. | |
| 4,998,695 | A | * | 3/1991 | Nobis | 248/101 |
| 5,020,751 | A | | 6/1991 | Larkin | |
| 5,065,891 | A | * | 11/1991 | Casey | 220/495.08 |
| 5,074,500 | A | * | 12/1991 | Loebbert | 248/99 |
| 5,275,490 | A | * | 1/1994 | Loebbert | 383/33 |
| 5,641,138 | A | * | 6/1997 | Cronk et al. | 248/99 |
| 5,826,838 | A | * | 10/1998 | Forbes | 248/97 |
| 5,836,553 | A | * | 11/1998 | Bergaila | 248/99 |
| 5,899,419 | A | * | 5/1999 | Ross et al. | 248/97 |
| 5,988,468 | A | | 11/1999 | Murdoch et al. | |
| 6,131,861 | A | * | 10/2000 | Fortier et al. | 248/98 |
| 6,209,596 | B1 | * | 4/2001 | Wong | 141/391 |
| 6,488,242 | B1 | * | 12/2002 | Barriere | 248/99 |
| 6,543,732 | B1 | * | 4/2003 | Yuan | 248/99 |

FOREIGN PATENT DOCUMENTS

GB 2 046 694 A * 11/1980

* cited by examiner

*Primary Examiner*—Ramon O Ramirez
*Assistant Examiner*—Kofi Schulterbrandt
(74) *Attorney, Agent, or Firm*—Richard C. Litman

(57) ABSTRACT

A disposable bag including a stand, the bag including an opening with a plurality of resilient overlapping leaves through which disposable items are inserted. The outer periphery of the bag has a flange that rests on a corresponding support ring of the stand. The bag includes an attached lid with a peripheral lip that snaps onto the flange.

19 Claims, 6 Drawing Sheets

DISPOSABLE BAG WITH STAND

BACKGROUND OF THE INVENTION

1. Field of the Invention

The present invention relates to bags for disposing of waste, and particularly to a disposable bag with a stand for supporting the bag. The bag has a mouth adapted for being grasped by a support ring which is mounted on a stand having a post for freestanding use on countertops and the like.

2. Description of the Related Art

The effective disposal of waste material in a sanitary manner is a chronic problem. This is especially true of certain health care or personal hygiene products which are capable of carrying disease through bacteria or germs, or which may have an offensive odor, such as sanitary napkins. The problem is often acute in public restrooms where the waste containers are often open top containers, or which have a single swing door closure which bulges open when the container is filled to capacity. Even in the home, the disposal of such waste may be a problem, as the sanitary napkin is often wrapped in toilet paper, tissues, or the like, and simply dropped into an open top waste basket. The problem is not limited to sanitary napkins, but also encompasses other waste products, such as food, which is subject to biological degradation and which attracts germs, parasites, and other disease carriers. Various devices have been proposed to provide for sanitary disposal of waste products.

U.S. Pat. No. 590,606, issued to Young on Sep. 28, 1897, teaches a bag including a lid held by a support. U.S. Pat. No. 755,085, issued to Viano on Mar. 22, 1904, teaches a frame for holding bags that is ring-shaped. U.S. Pat. No. 960,451, issued to Vicary on Jun. 7, 1910, teaches a ring-shaped bag holder. U.S. Pat. No. 2,528,332, issued to Bergquist on Oct. 31, 1950, teaches a self-closing opening using a plurality of overlapping flaps.

U.S. Pat. No. 4,312,489, issued to Paetzold on Jan. 26, 1982, teaches a bag holder for collapsible bags. U.S. Pat. No. 4,328,904, issued to Iverson on May 11, 1982, teaches a spill-proof container including a plurality of resilient overlapping flaps in its opening. U.S. Pat. No. 4,378,924, issued to Christensen on Apr. 5, 1983, teaches a wall-mounted ring-shaped bag holder including a removable lid.

U.S. Pat. No. 4,884,717, issued to Bussard et al. on Dec. 5, 1989, teaches a non-spilling snack container including non-overlapping flaps in a single-piece opening made by cutting a plurality of slits in the opening. U.S. Pat. No. 4,919,546, issued to Imazeki et al. on Apr. 24, 1990, teaches a trash bag including a holder and a disposable bag. U.S. Pat. No. 5,020,751, issued to Larkin on Jun. 4, 1991, teaches a garbage bag and holder including a lid. The bag includes a flange/lip that protrudes radially outward from the opening, and rests on a similarly sized support ring.

U.S. Pat. No. 5,988,468, issued to Murdoch et al. on Nov. 23, 1999, teaches a film container including overlapping flaps in the opening.

Various bag and bag holder combinations are taught in the prior art; however, there is a need for a disposable bag having an attached lid and an additional self-closing opening that can be easily mounted onto or removed from a corresponding support.

None of the above inventions and patents, taken either singly or in combination, is seen to describe the instant invention as claimed. Thus a disposable bag with a bag stand solving the aforementioned problems is desired.

SUMMARY OF THE INVENTION

The present invention is directed to a disposable bag with an attached lid and a corresponding support stand. More particularly, the support has a two-part ring for supporting the bag. The opening of the bag includes an outwardly projecting flange spaced from the opening and having a size similar to the ring that permits the bag to rest on the ring and be clamped in place by the ring. In addition, a second outwardly projecting flange near the opening provides an edge to snap the lid firmly onto the bag, thereby sealing the bag for disposal.

The disposable bag of the present invention also features a plurality of overlapping leaves projecting inwardly in the mouth of the bag. This construction permits a waste article to be dropped into the bag, and the leaves immediately resume their position covering the opening of the bag. In this way, unsanitary waste is covered until the bag is full and ready for disposal, both restricting the passage of airborne disease carriers, and ameliorating the problem of offensive odor.

Accordingly, it is a principal object of the invention to provide a disposable bag with stand having a lid attached to the bag and a corresponding support stand for holding the bag.

It is another object of the invention to provide a disposable bag with stand wherein the support includes a support ring and the bag includes an outwardly projecting flange having a size corresponding to the size of the ring so that the bag can be supported by the flange resting on the ring.

It is a further object of the invention to provide a disposable bag with stand which having a support ring which has two interconnecting parts so that the ring can clamp onto the bag near a flange about the mouth of the bag in order to hold the bag firmly onto the support.

It is another object of the invention to provide a disposable bag with stand in which the bag includes an additional flange near the opening to permit the lid to close the bag, thereby sealing the bag opening for disposal.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
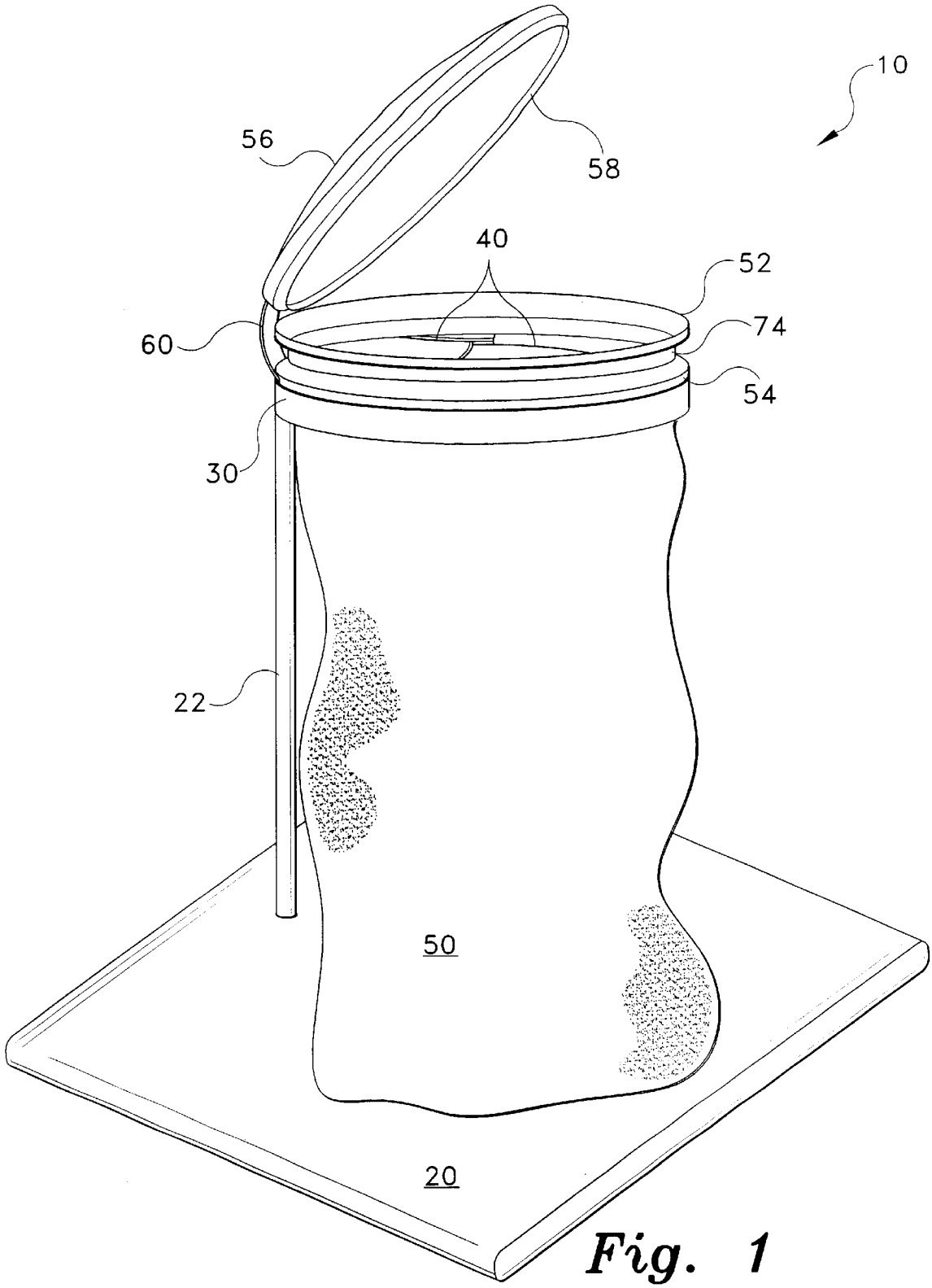
FIG. 1 is an environmental, perspective view of a disposable bag with stand in accordance with the invention.

FIG. 1 shows a perspective view of the disposable bag with stand according to the present invention, the combination being designated generally as 10 in the drawings. As shown, bag 50 is held on support ring 30, which, in turn, is attached to post 22 that is mounted on base 20. Although base 20 is shown in the drawings as a rectangular platform, it will be understood that the shape of the base 20 is not critical to the present invention, provided that the base 20 is sufficiently stable to support ring 30 and bag 50, as described below. For example, base 20 may be horseshoe or U-shaped, with a pair of legs projecting beneath ring 30 and bag 50.

Bag 50 includes a lid 56 attached to the bag 50 at an outwardly projecting lower flange 54 through a flexible hinge 60. However, it is noted that the hinge 60 can be attached to the bag 50 at any suitable location that permits the lid 56 to remain attached and be able to be opened and closed as appropriate. Alternatively, the lid 56 may be attached to the bag 50 by a tether.

At the opening or mouth of the bag 50 is a ring defining an outwardly projecting upper flange 52, an outwardly projecting lower flange 54, and an annular groove 74 defined between upper flange 52 and lower flange 54. When the lid 56 is closed, the outerlip 58 of the lid 56 snaps onto and around the flange 52, and into place in the groove 74, thereby sealing the lid 56 in place.

Inside the opening of the bag 50, is a set of overlapping resilient leaves or flaps 40. The flaps are capable of opening to permit objects to be inserted into the bag and they are capable of reclosing after the object(s) has(have) been inserted.

Figure 2:
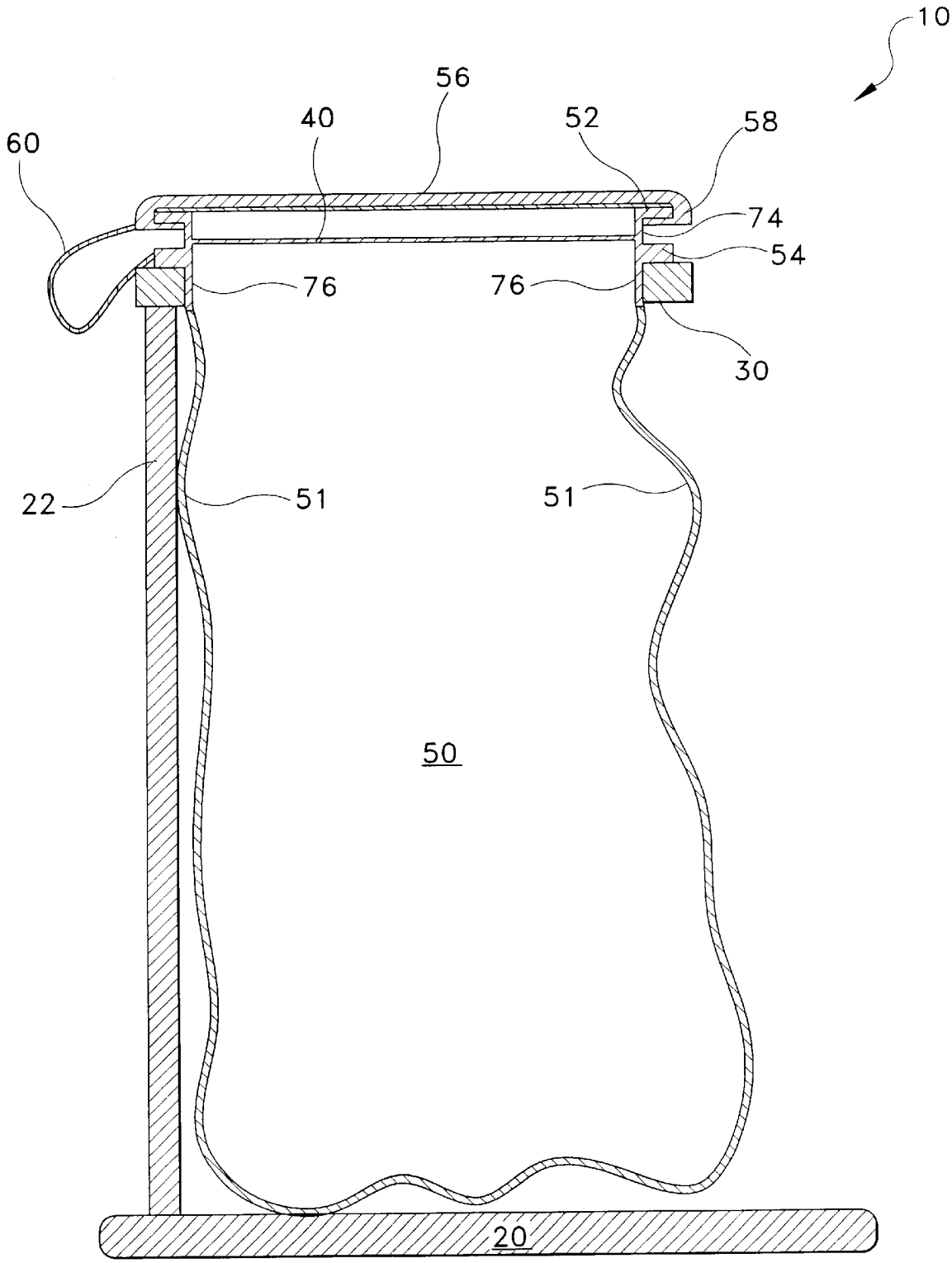
FIG. 2 is a cross-sectional elevational view of the bag and stand of FIG. 1.

FIG. 2 shows a cross-sectional view of the disposable bag with stand 10 with additional detail of the cooperation of the bag 50 with the stand. As explained in reference to FIG. 1, bag 50 includes an upper flange 52 and a lower flange 54 with an annular groove 74 between the two flanges. The groove 74 is sized to accommodate the inner peripheral edge of the lip 58 of lid 56. Also, it is noted that a short skirt 76 depends from the ring defining the mouth of the bag below the lower flange 54. Skirt 76 is provided with sufficient rigidity to permit the support ring 30 to adequately clamp onto and firmly hold the bag 50 in place. The body 51 of the bag 50 is attached to and depends from skirt 76, and is flexible, as is known in the art of disposable trash bags.

Figure 3:
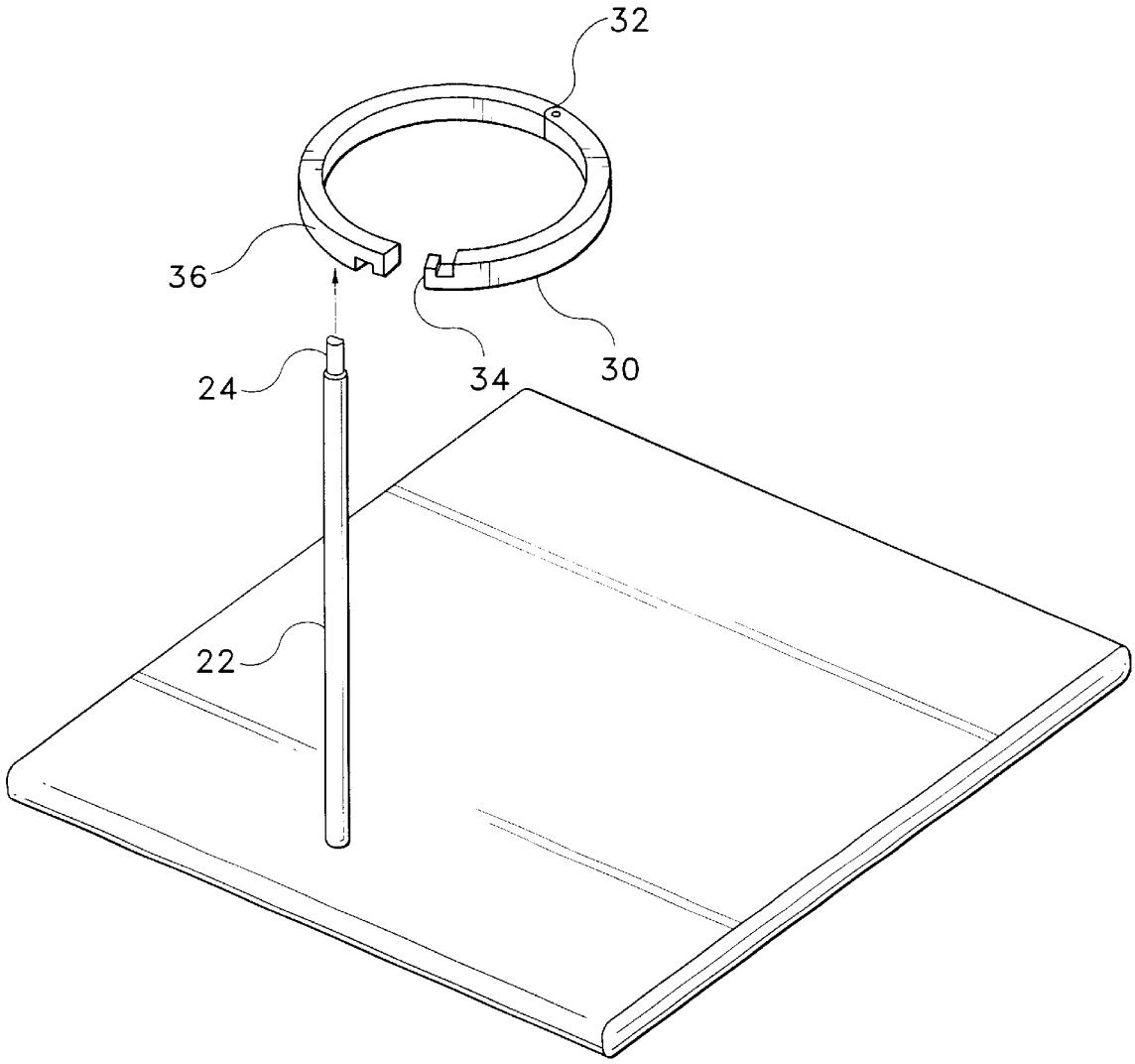
FIG. 3 is an exploded perspective view of the stand showing the relationship of the support ring with the brace.

FIG. 3 shows an exploded view of support ring 30 having two portions, with respective connectable ends, 34 and 36. End 34 can swing away from end 36 by pivoting about hinge 32. Ring 30 can be attached to post 22 in any suitable manner, including, for example, by a pin 24 inserted into a corresponding hole (not shown) in the underside of end 36 of ring 30.

Figure 4:
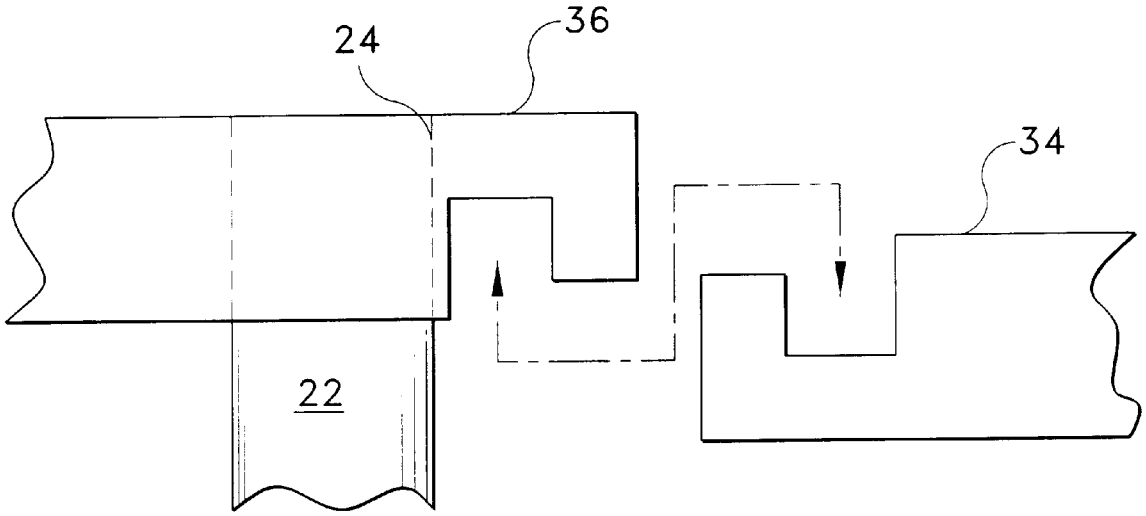
FIG. 4 is a detailed view of the connecting ends of the support ring.

A detailed view of one possible configuration of connectable ends 34 and 36 is shown in FIG. 4, which shows ends 34 and 36 connected in matching single tooth fashion. However, any suitable manner of connecting the ends is contemplated, so long as the ring 30 can be securely closed to clamp onto the bag 50 and can be easily opened to release the bag 50.

Figure 5A:
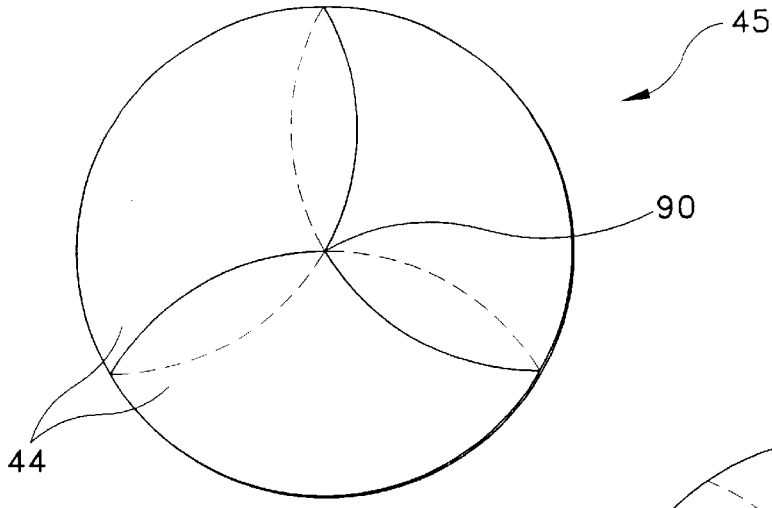
FIGS. 5A, 5B and 5C are plan views of alternative arrangements of overlapping leaves in the bag opening.
Figure 5B:
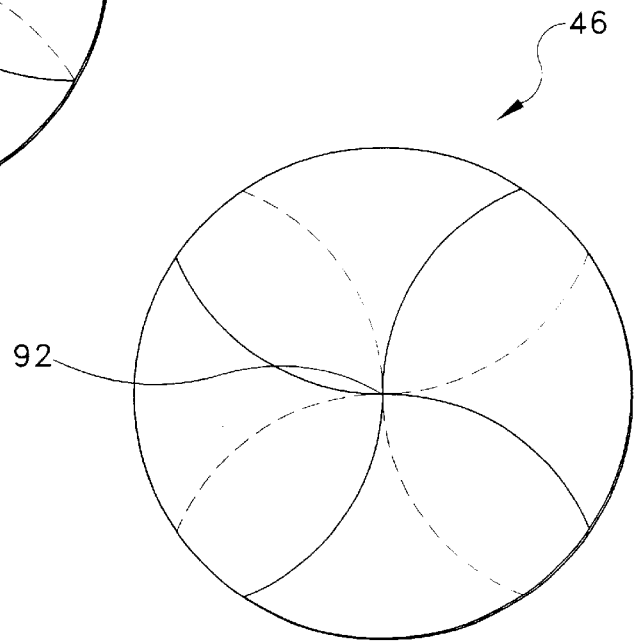
Figure 5C:
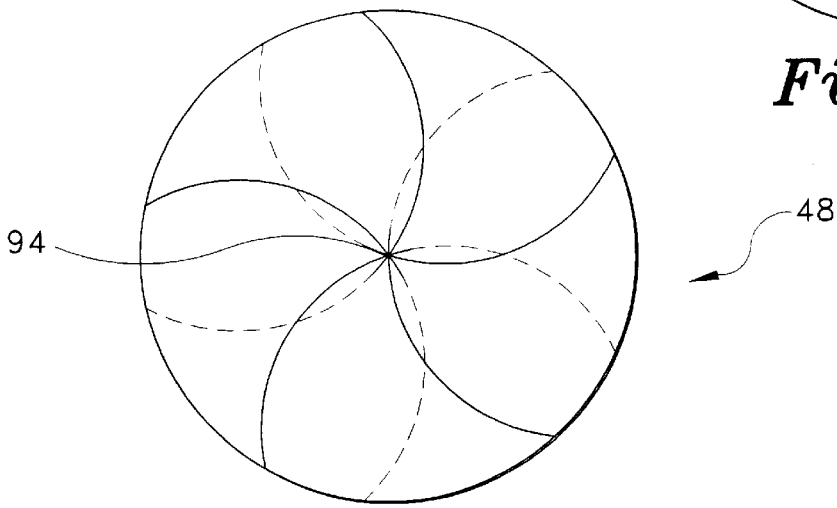

Alternative arrangements of the flaps in the opening of the bag are shown in FIGS. 5A, 5B, and 5C. These figures show a three flap 45, four flap 46, and five flap 48 arrangement, respectively. Each arrangement includes a center opening, 90,92 and 94, respectively. Center openings should be as small as possible to ensure that objects inserted in the bag 50 cannot fall out if the bag 50 is removed from the stand and inverted. Also, the closed flaps 40 can substantially prevent odors and other gases, as well as airborne disease carriers, from escaping the bag 50, if the discarded objects inserted in the bag 50 include such gases or other volatile ingredients.

Figure 6:
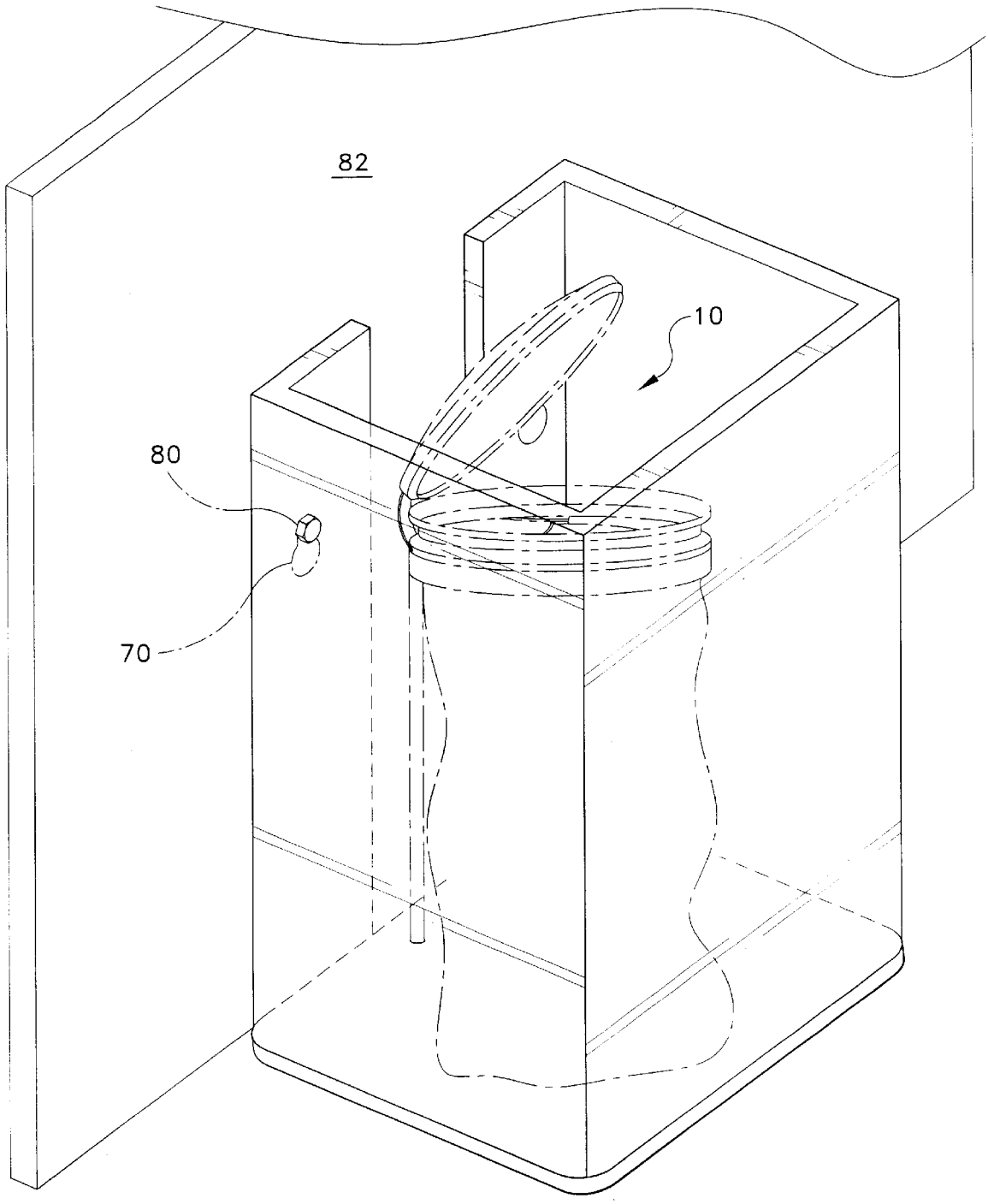
FIG. 6 is a perspective view of the bag and stand including a protective enclosure.

FIG. 6 shows the disposable bag with stand 10 mounted onto a vertical surface, such as a wall 82, in this case using a screw-and-slot arrangement, 80 and 70. It will be understood that in this embodiment, base 20 includes a plurality of upright enclosure walls a rising from a rectangular platform, with slot 70 being defined in the enclosure wall abutting vertical surface 82.

The material used for the flaps 40 is any suitably firm, resilient material that can permit objects to be inserted into the bag 50, yet still be able to return to a closed position.

It is noted that the post 22 and/or the base 20 can be fastened to any existing support, e.g., a wall 62, using any suitable manner of attachment, such as an adhesive, rather than using screws or other mechanical devices. Moreover, the support ring 30 itself can be mounted directly onto any existing support, using a bracket with known "sliding screws", that permit the ring 30 to be easily moved toward or away from the existing support. Furthermore, the bag 50 can be transported separately, e.g., in a knapsack, to be used as a container for various types of items.

Also, the base 20 is preferably rounded along all sides to prevent skin abrasions during use, e.g., when the disposable bag with stand 10 are used in a moving vehicle and when the stand accidentally becomes dislodged during vehicle travel. Alternatively, instead of a squarish shape, the base 20 can be U-shaped, or any suitable shape that adequately supports the ring 30 and bag 50.

Regarding the internal features of the bag 50, in addition to conventional bags, such as paper, fiber, textile, plastic, composite, or any combination of these, the interior of the bag 50 may be treated with, coated with, or incorporate odor eliminating compositions, scents, perfume, antimicrobial compositions, etc., to reduce or eliminate odors or to sanitize the contents of the bag 50.

It is noted that the bag 50, including the lid 56, hinge 60 and overlapping leaves 40 in the opening, are all disposable. Therefore, the material chosen for all of these interconnected parts is necessarily environmentally acceptable for use in a landfill or reuse in a recycling facility, depending upon the particular objects and items discarded. Exemplary disposable materials include paper, coated paper, plastic, The dimensions of the bag 50 opening and support ring 30 are preferably about 3 inches, and the length of the bag 30 and height of the post 22 are about ten inches, for use on top of a counter, such as in a kitchen, hospital, bedroom, bathroom, or for inside of a vehicle, etc. However, the dimensions can be made as large as necessary, while keeping the relative dimensions the same, to use the disposable bag with stand 10 as a general use container, rather than solely for disposing of items. For example, the bag 50 could be used to hold various automotive objects, such as bolts, screws, and other hardware and tools for use in mechanical shop.

In order to obtain the necessary resiliency for the overlapping leaves in the mouth of the bag 50, elastomeric plastics, such as rubber can be used. For the more rigid flanges 52 and 54, annular groove 74, and rigid ring 76 below the flange 54, a sturdier material must be used. This could include rigid plastics or metal-reinforced composite, for example.

Finally, the material for the support ring 30, post 22 and support base 20 can be any material having a suitable strength and durability to hold the bag 50 and its contents, including metal, hard plastic and combinations thereof.

It is to be understood that the present invention is not limited to the embodiment described above, but encompasses any and all embodiments within the scope of the following claims.

I claim:

1. A disposable bag, comprising:

an elongated flexible container with two opposing ends, one of the ends being open, the container defining a bag;

a ring disposed about the open end of the bag and defining a mouth of the bag, the ring having an outwardly protecting upper flange, an outwardly projecting lower flange, and an annular groove defined between the upper flange and the lower flange, the upper and lower flanges and annular groove extending around the mouth of the bag;

a lid attached to the ring, the lid having a circumference and having an inwardly protecting peripheral lip extending about the circumference of the lid, the lip being sized and dimensioned for snapping into the annular groove defined around the mouth of the bag; and a skirt depending from the lower flange of the ring defining the mouth of the bag;

whereby the lid is snapped shut around the mouth of the bag in order to seal the bag for disposal.

2. A disposable bag, comprising:

an elongated flexible container with two opposing ends, one of the ends being open, the container defining a bag;

a ring disposed about the open end of the bag and defining a mouth of the bag, the ring having an outwardly projecting upper flange, an outwardly projecting lower flange, and an annular groove defined between the upper flange and the lower flange, the upper and lower flanges and annular groove extending around the mouth of the bag;

a lid attached to the ring, the lid having a circumference and having an inwardly protecting peripheral lip extending about the circumference of the lid, the lip being sized and dimensioned for snapping into the annular groove defined around the mouth of the bag;

a plurality of flexible, overlapping leaves resiliently, attached to the ring defining the mouth of the bag and extending inward to cover the open end of the bag, whereby when an article is placed into the open end of the bag, the article passes through the leaves into the bag for disposal and the leaves return to a position extending inward in order to cover the open end of the bag and the lid is snapped shut around the mouth of the bag in order to seal the bag for disposal.

3. The disposable bag according to claim 1, wherein said elongated container is made from paper.

4. The disposable bag according to claim 1, wherein said elongated container is made from plastic.

5. The disposable bag according to claim 1, further comprising a flexible hinge disposed between said lid and the lower flange of the ring defining the mouth of said bag, whereby said lid is pivotally attached to said bag.

6. The disposable bag according to claim 1, further comprising a tether having one end attached to said lid and a second end attached to the lower flange of the ring defining the mouth of said bag, whereby said lid is pivotally attached to said bag.

7. A disposable bag with stand, comprising:

an elongated flexible container with two opposing ends, one of the ends being open, the container defining a bag;

a ring disposed about the open end of the bag and defining a mouth of the bag, the ring having an outwardly projecting upper flange, an outwardly projecting lower flange, and an annular groove defined between the upper flange and the lower flange, the upper and lower flanges and annular groove extending around the mouth of the bag, the ring further having a skirt depending from the lower flange and extending around the mouth of the bag;

a lid attached to the ring, the lid having a circumference and having an inwardly projecting peripheral lip extending about the circumference of the lid, the lip being sized and dimensioned for snapping into the annular groove defined around the mouth of the bag; and a stand, the stand having:

a base;

a post extending upward from the base; and a support ring attached to the post, the support ring being a split ring having a first end, a second end, and means for temporarily fastening the first end to the second end;

wherein the bag is supported by the stand when the support ring is disposed around the skirt and the first and second ends of the support ring are fastened together; and whereby the lid is snapped shut around the mouth of the bag in order to seal the bag for disposal.

8. The disposable bag with stand according to claim 7, further comprising a plurality of flexible, overlapping leaves resiliently attached to the ring defining the mouth of the bag and extending inward to cover the open end of the bag, whereby when an article is placed into the open end of the bag, the article passes through the leaves into the bag for disposal and the leaves return to a position extending inward in order to cover the open end of the bag.

9. The disposable bag with stand according to claim 7, wherein said elongated container is made from paper.

10. The disposable bag with stand according to claim 7, wherein said elongated container is made from plastic.

11. The disposable bag with stand according to claim 7, further comprising a flexible hinge disposed between said lid and the lower flange of the ring defining the mouth of said bag, whereby said lid is pivotally attached to said bag.

12. The disposable bag with stand according to claim 7, further comprising a tether having one end attached to said lid and a second end attached to the lower flange of the ring defining the mouth of said bag, whereby said lid is pivotally attached to said bag.

13. The disposable bag with stand according to claim 7, wherein said base comprises a rectangular platform.

14. The disposable bag with stand according to claim 13, wherein said base further comprises a plurality of enclosure walls extending upward from said rectangular platform in order to enclose the disposable bag.

15. The disposable bag with stand according to claim 14, wherein at least one of said plurality of enclosure walls has a slot defined therein, whereby said base is adapted for attachment to a vertical support surface.

16. The disposable bag according to claim 2, wherein said elongated container is made from paper.

17. The disposable bag according to claim 2, wherein said elongated container is made from plastic.

18. The disposable bag according to claim 2, further comprising a flexible hinge disposed between said lid and the lower flange of the ring defining the mouth of said bag, whereby said lid is pivotally attached to said bag.

19. The disposable bag according to claim 2, further comprising a tether having one end attached to said lid and a second end attached to the lower flange of the ring defining the mouth of said bag, whereby said lid is pivotally attached to said bag.

* * * * *